US010996027B2

(12) United States Patent
Gonzalez

(10) Patent No.: US 10,996,027 B2
(45) Date of Patent: May 4, 2021

(54) BALLISTIC SHIELD AND METHOD OF USING MULTIPLE INTERCONNECTED BALLISTIC SHIELDS TO PROTECT A GROUP OF INDIVIDUALS

(71) Applicant: SGN INNOVATIONS, LLC, Riverview, FL (US)

(72) Inventor: Samuel Gonzalez, Riverview, FL (US)

( * ) Notice: Subject to any disclaimer, the term of this patent is extended or adjusted under 35 U.S.C. 154(b) by 93 days.

(21) Appl. No.: 16/410,172

(22) Filed: May 13, 2019

(65) Prior Publication Data

US 2020/0348108 A1 Nov. 5, 2020

Related U.S. Application Data

(60) Provisional application No. 62/671,041, filed on May 14, 2018.

(51) Int. Cl.
*F41H 5/08* (2006.01)

(52) U.S. Cl.
CPC ..... *F41H 5/08* (2013.01)

(58) Field of Classification Search
CPC ..... F41H 5/06; F41H 5/08; F41H 5/013
USPC ..... 89/36.04–36.07
See application file for complete search history.

(56) References Cited

U.S. PATENT DOCUMENTS

H129 H * 9/1986 Hansen ..... 52/764
5,377,577 A * 1/1995 Bounkong ..... F41H 5/08 2/2.5
8,276,498 B1 10/2012 Hannibal
8,418,595 B1 3/2013 Saucedo
9,212,871 B2 * 12/2015 White ..... F41H 5/08
2004/0107823 A1 * 6/2004 Kiley ..... B65D 90/325 86/50
2012/0291619 A1 * 11/2012 White ..... F41H 5/08 89/36.02
2014/0130438 A1 * 5/2014 Durst ..... F41H 5/04 52/638
2015/0096479 A1 * 4/2015 McCarthy ..... A47F 9/00 109/1 S
2015/0300784 A1 * 10/2015 Scarinci ..... F41H 5/013 89/36.02
2015/0308792 A1 * 10/2015 Tyler ..... F41H 5/013 89/36.02

(Continued)

*Primary Examiner* — Samir Abdosh
(74) *Attorney, Agent, or Firm* — Jeffrey S. Melcher; Melcher Patent Law PLLC

(57) ABSTRACT

Provided is a ballistic shield having a body formed from a ballistic resistant material and sized to protect at least a torso of an individual. A first flap is connected to a side of the body that is configured to fold into a first closed position and a first open position, in the first open position the first flap is configured to connect to second body of a second ballistic shield. A second flap is connected to a bottom of the body that is configured to fold into a second closed position and a second open position, in the second open position the second flap is configured to connect to second body of a second ballistic shield. A corner flap is connected to the first flap or the second flap, the corner flap is configured to fold into a third closed position and a third open position, in the third open position the corner flap is configured to cover any openings between a corner of the first body and a corner of the second body. Also provided is a method of connecting a plurality of the ballistic shields together to protect a group of individuals.

20 Claims, 5 Drawing Sheets

(56) References Cited

U.S. PATENT DOCUMENTS

2017/0291749 A1* 10/2017 Blackway ..... B65D 43/02

* cited by examiner

REAR VIEW

FRONT VIEW

2
BALLISTIC PANEL
(LEVEL III)
14
FRAME
(TRAUMA PAD)
12
BALLISTIC SHIELD
HANDLES
6
BALLISTIC FLAP
DEPLOYED
FLAP OPENS
OUTWARDS
4
BALLISTIC FLAP
CLOSED 5
6
BALLISTIC FLAP
DEPLOYED
7
8
FLAP OPENS
OUTWARDS
9
10
FLAP OPENS
DOWNWARDS
11
13
SCALE: N.T.S.

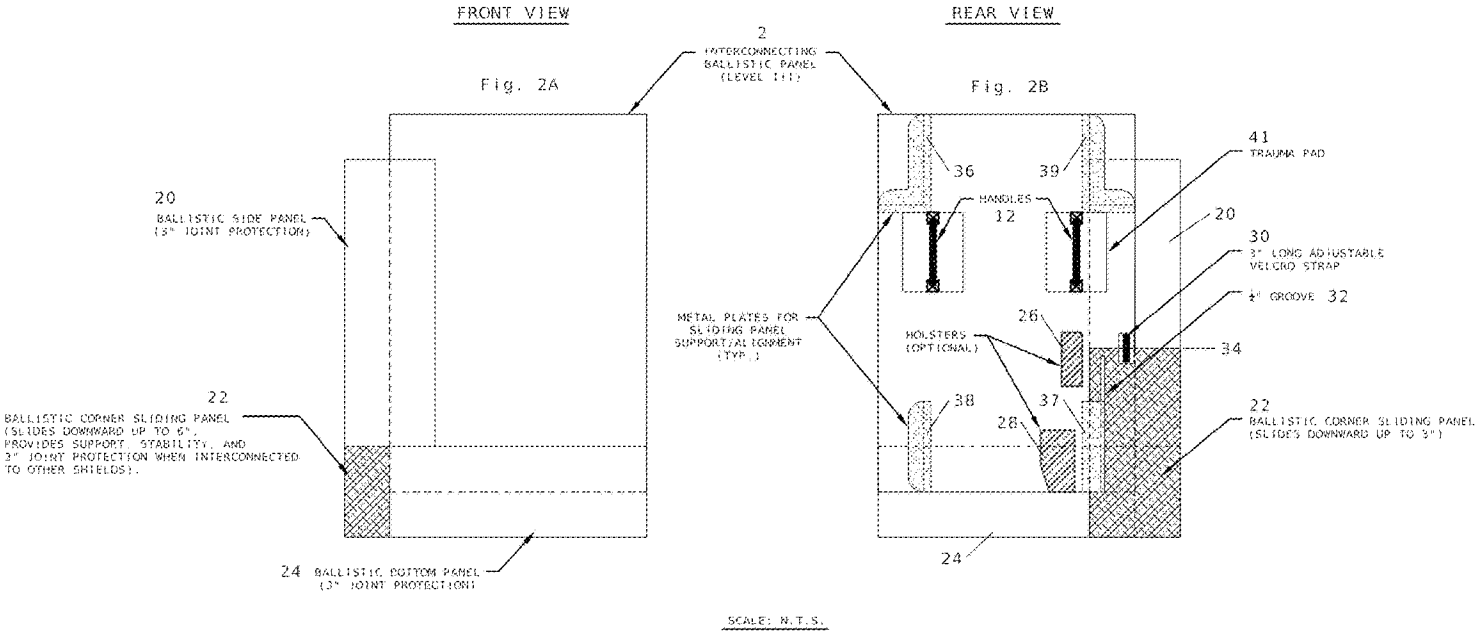
REAR VIEW
Fig. 2B
FRONT VIEW
Fig. 2A
41 TRAUMA PAD
20
30 3" LONG ADJUSTABLE VELCRO STRAP
4" GROOVE 32
34
22 BALLISTIC CORNER SLIDING PANEL (SLIDES DOWNWARD UP TO 9")
39
HANDLES 12
26
37
28
36
38
HOLSTERS (OPTIONAL)
24
2 INTERCONNECTING BALLISTIC PANEL (LEVEL III)
METAL PLATES FOR SLIDING PANEL SUPPORT AT EGRESS (TYP.)
SCALE: N.T.S.
20 BALLISTIC SIDE PANEL (3" JOINT PROTECTION)
22 BALLISTIC CORNER SLIDING PANEL (SLIDES DOWNWARD UP TO 9". PROVIDES SUPPORT, STABILITY, AND 3" JOINT PROTECTION WHEN INTERCONNECTED TO OTHER SHIELDS).
24 BALLISTIC BOTTOM PANEL (3" JOINT PROTECTION)

Fig. 3A
FRONT VIEW
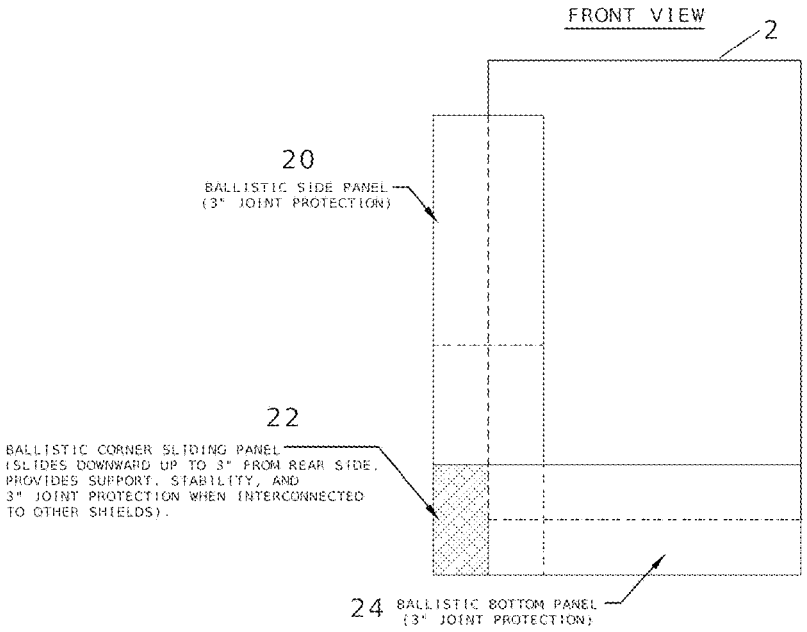
Fig. 3B
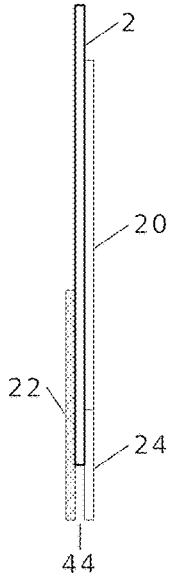
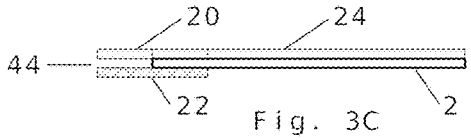
Fig. 3C
Fig. 3D
REAR VIEW
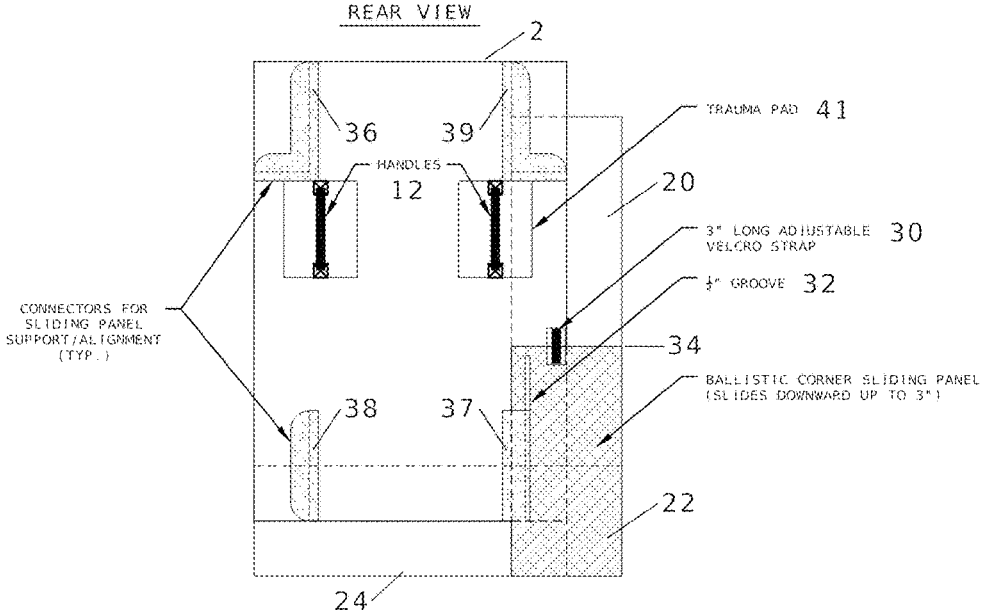

REAR VIEW
DEPLOYMENT DETAIL

REAR VIEW
OPTIONAL SERVICES

BALLISTIC SHIELD AND METHOD OF USING MULTIPLE INTERCONNECTED BALLISTIC SHIELDS TO PROTECT A GROUP OF INDIVIDUALS

The application claims priority to U.S. Provisional Application No. 62/671,041, filed 14 May 2018, the complete disclosure of which is incorporated herein by reference.

FIELD OF THE INVENTION

The invention relates to a ballistic shield and a method of using a plurality of interconnected ballistic shields to protect a group of individuals.

BACKGROUND OF THE INVENTION

U.S. Pat. No. 8,418,595 illustrates a ballistic shield for protecting a single user, the complete disclosure of which is incorporated herein by reference. This shield discloses multiple small parts that can be extended vertically to provide a single body shield.

U.S. Pat. No. 8,276,498 discloses a ballistic shield system for protecting a single user, the complete disclosure of which is incorporated herein by reference.

SUMMARY OF THE INVENTION

An objective of the invention is to provide an improved ballistic shield that can be utilized by an individual and which can be interconnected to provide protection to a group of individuals.

The above objectives and other objectives can be obtained by ballistic shield comprising:

- a first body formed from a ballistic resistant material and sized to protect at least a torso of an individual; and
- a first flap on a side of the body that is configured to fold into a first closed position and a first open position, in the first open position the first flap is configured to connect to second body of a second ballistic shield.

The above objectives and other objectives can also be obtained by a ballistic shield comprising:

- a first body formed from a ballistic resistant material and sized to protect at least a torso of an individual; and
- a side panel on a side of the body; and
- a movable corner panel configured to move from an open position and a closed position so that in the closed position the corner panel can lock two more panels together, wherein the body is constructed to be connectable to at least one other body with the first panel and corner panel covering gaps between adjacent bodies.

The above objectives and other objectives can be obtained by a method of protecting a plurality of individuals comprising:

- connecting a plurality of the ballistic shields according to claim 1 together to protect a plurality of individuals.

BRIEF DESCRIPTION OF THE DRAWINGS

FIG. 2A illustrates a front view of a second embodiment of the ballistic shield.

FIG. 2B illustrates a rear view of second embodiment of the ballistic shield.

FIG. 3A illustrates a front view of a second embodiment of the ballistic shield.

FIG. 3B illustrates a side view of a second embodiment of the ballistic shield.

FIG. 3C illustrates a bottom view of a second embodiment of the ballistic shield.

FIG. 3D illustrates a rear view of a second embodiment of the ballistic shield.

DETAILED DESCRIPTION OF THE INVENTION

Figures 1A, 1B:
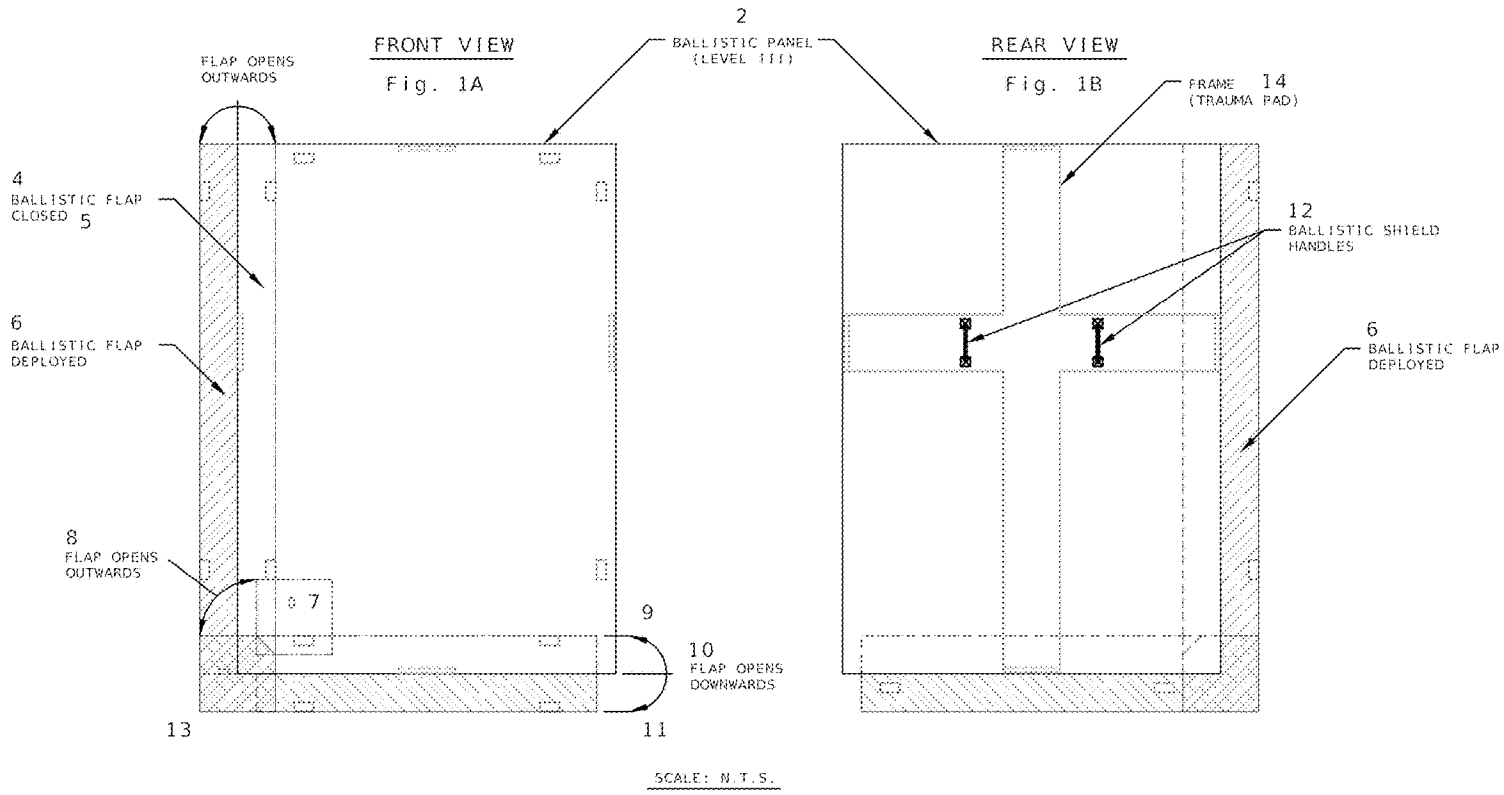
FIG. 1A illustrates a front view of a first embodiment of the ballistic shield.
FIG. 1B illustrates a rear view of the first embodiment of the ballistic shield.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

The attached Figures illustrate and embodiment of the ballistic shield. Materials and methods for making ballistic shields are now well known in the art and any conventional ballistic material, structure and method can be utilized in the present invention. For example, the ballistic shield can be formed from one or more materials known to be useful for constructing body armor and ballistic shields. The material can be bullet-proof and knife blade slash-proof to maximize the protection offered to the enforcement personnel using the shield. One such material is a woven fabric formed from KEVLAR plastic fibers, which may be incorporated into a laminate or encased in a resin. KEVLAR products are available from E.I. DuPont de Nemours and Company. Another material is a ceramic armor made of boron carbide, silicon carbide, silicon nitride, aluminum oxide or alumina ceramic, or titanium diboride, available from Ceradyne, Inc., Life-Guard Ballistic Armor, Lumagard Prolite Armor Systems, and Morgan Advanced Ceramics. A further alternate material is a composite of synthetic fibers encased in a resin matrix, such as SPECTRA SHIELD polyethylene fiber composites and GOLD SHIELD aramid fiber composites available from Allied Signal. TWARON aramid fibers from Akzo Nobel also may be used. A further suitable example is Dyneema® Fiber. The resulting shield formed with such material should perform satisfactorily, such as to meet the level III, Level IIIA NIJ 010801 STD law enforcement safety rating for ballistic protection.

The invention will now be explained with reference to the attached non-limiting Figures.

FIGS. 1A and 1B illustrate a first embodiment of the ballistic shield, in which the ballistic shield comprises a body 2 sized to protect at least a torso of an individual. Examples of suitable sizes are from 10 to 30 inches wide, preferably 15 to 25 inches wide, by 10 to 40 inches in length, preferably 15 to 30 inches in length. Specific examples are 20 inches by 28 inches for high school students and 16 inches by 22 inches for elementary students. The body can have a frame 14 for support.

The ballistic shield preferably includes a side flap 4 that can fold into an open position 6 and a closed position 5. The side flap 4 is preferably the length of the body 2. The side flap 4 can be held in the open 6 or closed 5 position by a magnet, such as a neodymium magnet, or any other desired connecting means, such as Velcro. Suitable examples of the side flap are from 1-10 inches, preferably at least 6 inches in width to provide an overlap of 3 inches on each body panel 2.

The side flap, when in the open position can be used to connect to the body 2 of another ballistic shield by the magnet, or other connecting means, such as Velcro, so that the two ballistic shields are connected side-by-side. Any number of ballistic shields can be connected side-by-side.

The ballistic shield preferably includes a bottom flap 10 that can fold into an open position 11 and a closed position 9. The bottom flap 10 is preferably the width of the body 2. The bottom flap 10 can be held in the open or closed position by a magnet, such as a neodymium magnet, or any other desired means, such as Velcro. Suitable examples of the bottom flap are from 1-10 inches, preferably at least 6 inches in width to provide at least 3 inches of overlap on each body panel 2. The bottom flap 10, when in the open position 11 can be used to connect to the body 2 of another ballistic shield by the magnet, or other connecting means, such as Velcro, so that the two ballistic shields connected top-to-bottom. Any number of ballistic shields can be connected top-to-bottom.

The ballistic shield preferably includes a corner flap 8 that can fold into an open 13 position and a closed position 7. The corner flap 8 is preferably sized to cover any opening between corners of adjacent connected ballistic shields. The corner flap 8 can be connected to either of the body 2, the side flap 4 or the bottom flap 10. The corner flap 8 can be held in the open 13 or closed 7 position by a magnet, such as a neodymium magnet, or any other desired means, such as Velcro. Suitable examples of the corner flap 8 are from 1-10 inches wide by 1-10 inches long, preferably at least 6 inches wide by at least 6 inches long to provide at least a 3 inch overlap on each body panel 2.

The preferred shape of the body 2 is square or rectangular. However, the body 2 can have any shape as desired. The body 2 preferably includes handles 12 for the user to hold the ballistic shield up between the user and an assailant. The handles 12 can also have a trauma pad 41 to reduce or prevent injury during use.

FIGS. 2A and 2B illustrate another embodiment of the invention in which the shields interlock using slots and panels. The shield has a body 2 as described in the first embodiment. However, in place the movable side flap 4, the bottom flap 10 and corner flap 8, the shield has a side panel 20, a slideable corner panel 22 and a bottom panel 24. Preferably, the panels 20, 22, and 24 are sized to provide at least a minimum of 3 inch overlap on the body 2 and an adjacent body 2. Thus, suitable examples of are from 6-12 inches, preferably 6 inches in width.

The side panel 20 is located on an outside side surface of the body 2 so that the side panel 20 over hangs at least 3 inches. The side panel 20 can extend the length or less of the side of body 2. When the body 2 is connected to another body 2 side-to-side, the side panel 20 covers a side gap between the side-by-side bodies 2.

The bottom panel 24 is located on an outside bottom surface of the body 2 so that the bottom panel 24 over hangs at least 3 inches. The bottom panel 24 can extend the length of the bottom of the body 2. When the body 2 is connected to another body 2 top-to-bottom, the bottom panel 24 covers a bottom gap between the top body 2 and bottom body 2.

The corner panel 22 is configured to slide between a first open position 34 and a second locking position 46. When in the locked position 46, the corner panel 22 covers a corner gap between top-and-bottom bodies 2 and side-by-side bodies 2, preferably providing at least a 3 inch overlap joint protection and to provide support and stability.

A lock 30 can be locked in a first position to lock the corner panel 22 in the open position 34. An example of the lock 30 is Velcro. The lock 30 can be locked in a second position 48 to lock the corner panel 22 in the locked position 46.

The shield body 2 can have four connectors, an upper right connector 39 in an upper right part of the body 2, an upper left connector 36 in an upper left part of the body 2, a lower right connector 37 in a lower right part of the body 2, and a lower left connector 38 in a lower left part of the body 2. The connectors 36, 38 and 39 each constructed to have at least one slot configured to accept a part of a side panel 20, corner panel 22 or bottom panel 24 from an adjacent body 2. The side view of FIG. 3B shows a slot 44 formed between the panel 22, panel 24 and edge of the body 2 configured to accept part of an adjacent body 2.

The upper right connector 36 comprises a side slot for a corner panel 22 to slide in and an end slot to engage an end of the corner panel 22 and prevent further sliding when the corner panel 22 is in a locked position 46. The upper left connector 39 comprises a side slot for a corner panel 22 to slide in and an end slot to engage an end of the corner panel 22 and prevent further sliding when the corner panel 22 is in a locked position 46. The lower left connector 38 has a slot for a corner panel 22 to slide in. The lower right connector 37 has a slot for a corner panel 22 to slide in. The lower right connector 37 also retains the corner panel 22 by engaging a' groove 32 in the corner panel so that the corner panel 22 can slide in relation to the lower right connector 37 but cannot be removed from the lower right connector 37.

Figure 4:
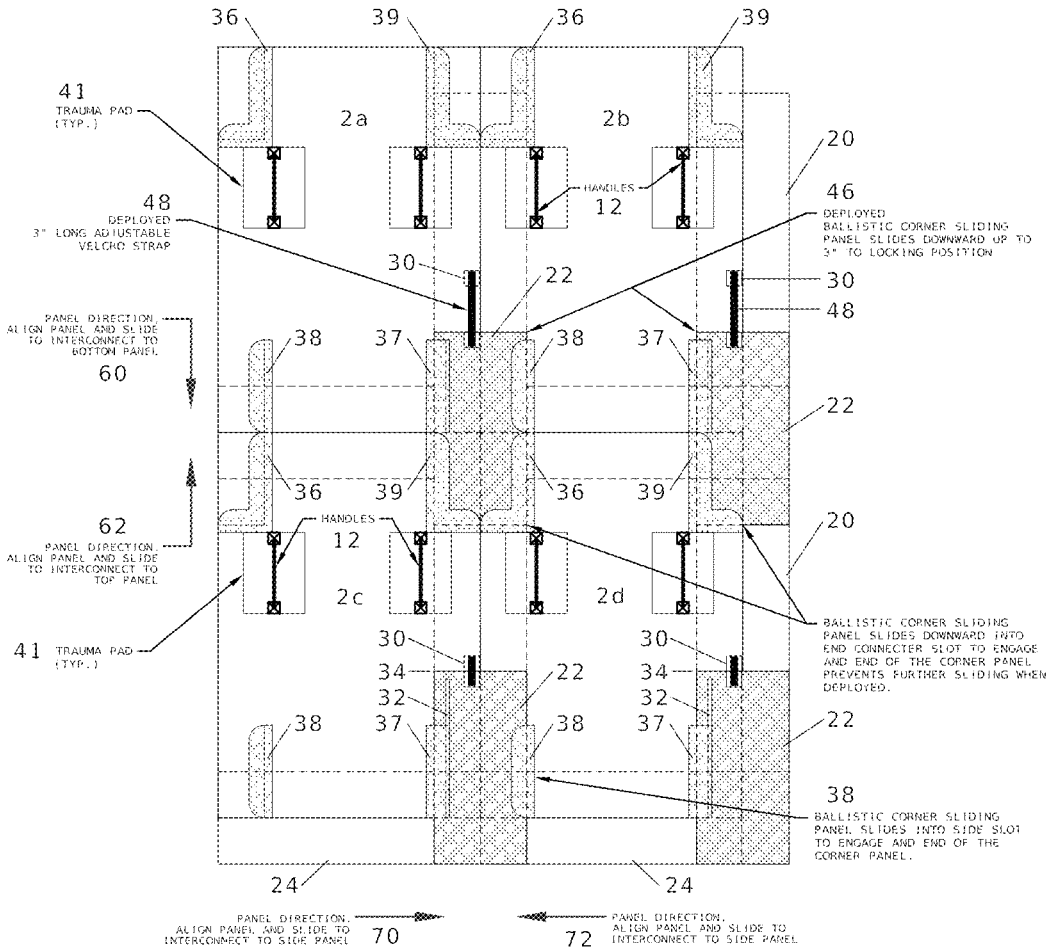
FIG. 4 illustrates a view of four ballistic shields connected together.
Figure 5:
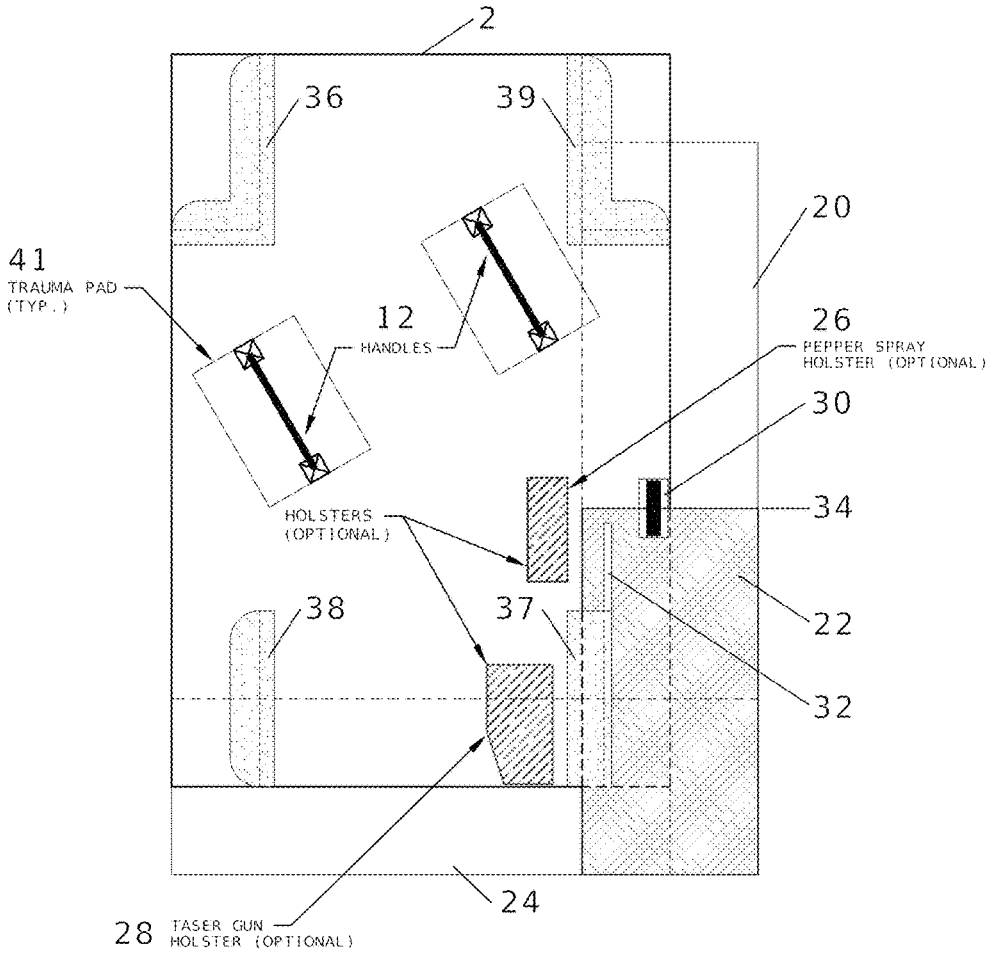
FIG. 5 illustrates a view of options for a ballistic shield.

The shields are preferably constructed to be self aligning with each other. For example, as shown in FIG. 4, four shields can have their bodies 2*a*, 2*b*, 2*c*, 2*d* adjacent to one another, with two above 2*a*, 2*b* and two below 2*c*, 2*d* to form a larger shield. The bottom panel 24 of a top left body 2*a* covers any gap between the top left body 2*a* and the bottom left body 2*c*. The bottom panel 24 of a top right body 2*b* covers any gap between the top right body 2*b* and the bottom left body 2*d*. The side panel 20 of the top left body 2*a* covers any gap between the top left body 2*a* and the top right body 2*b*. The side panel 20 of the bottom left body 2*c* covers any gap between the bottom left body 2*c* and the bottom right body 2*d*. The corner panel 22 of the top left body 2*a* can be slid into a locking position 46 to cover a gap between the four bodies 2*a*, 2*b*, 2*c* and 2*d*. The location of the panels can be altered as desired as long as when a plurality of bodies 2 are connected, all gaps between the bodies 2 are covered by the ballistic material of the panels. A top left body 2*a* can connected to a lower left body 2*s* as shown in FIG. 4 by sliding them together in the directions shown at 60 and 62. A lower left body 2*c* can connected to a lower right body 2*d* as shown in FIG. 4 by sliding them together in the directions shown at 70 and 72.

The four bodies 2*a*, 2*b*, 2*c*, 2*d*, can be locked together by sliding the corner sliding panel 22 down into a locked position shown at 46. The locked corner panel 46 contacts the slot of left upper connecter 36 of the bottom right body 2*c*, the slot of the upper right connector 39 of the bottom left body 2*d*, the slot of the lower right connector 37 of the body 2*a*, and the slot of the lower left connector 38 of the body 2*b*. Any size shield can be formed by adding bodies 2 on any side. The bodies are designed to easily connect with one another on any side, i.e. left side, right side, top and bottom.

The shield can optionally have a holster 26 configured to hold pepper spray. The shield can optionally have a holster 28 configured to hold a taser or stun gun.

The interconnecting ballistic shield is designed as a method for protecting a user with a protective weapon from projectiles, such as bullets or arrow, from an assailant.

1. Providing a lightweight shield with the option to be stored and accessible within reach to protect the user immediately from known threat.

2. Providing a shield assembly with an option to interconnect with another shield, with a right side flap, bottom side flap, and lower right corner flap. Deployment of the shield assembly; the weight of the ballistic material will assist in positioning the flap in place to connect with the other shield, providing protection from projectiles between shield joints. Interconnecting the shields to all its sides with other users effectively and efficiently, will create a greater protective defensive wall.

3. The cross frame 14 has a plate that runs left to right and contains connectors at each ends to interconnect to others shields by their sides. There are also connectors on the frame plate at each end of the frame to interconnect to the other shields from the bottom to top, this part of the frame provide bottom structure support when interconnecting with other shields.

4. The ambidextrous handles 12 are connected to the left to right cross frame 14 and provides support to the hand and arm when handling. Orientation of the ambidextrous handles 12 vary to client specifications and when optional items are added.

Functionality: Users can protect themselves individually or work together in unity to create a greater area of protection to the body and towards each other by interconnecting each individual shield and creating a large protective defensive wall, until local law enforcement arrive to assist. The shield is intended to be strategically placed within short reach for quick access and handling. The shield has a quick semi-automatic connections to the other shields to assist the user when interconnecting to the other shield. The shield has ballistic protecting flaps in the front of the shield for additional protection over the joints when connected side by side. The shield has connectors strategically placed and aligned that will attached with the other shield when in close proximity. Flaps will come in two different connecting materials.

Benefits: Provides personal protection against assailants. Impedes the assailant from accomplishing his intended purpose. Reduces lethal injuries. Reduces the possibilities of mass casualties. Increases the chances of saving lives. Allows users to work together in unity to increase the area of protection. Allows users to work together in unity to create a larger protective defensive barrier wall. Allows protected users to communicate with their families. Allows protected users to assists local law enforcement to better assess the situation. Allows protected users to assists local law enforcement to properly identify the location and description of the assailant. Allows protected users to assist local law enforcement to go directly to the assailant and take them down. Allows protected users to communicate from within the active crime scene. Provides a sense of protected comfort to the user in the most crucial time. Provides a greater area of protection over each other (the users) until local law enforcements arrive to assist. Allows the user to maintain a better level of composure during critical times. Allows users to care and protect each other and be able to see another day and enjoy life with their friends and families.

It should be understood, of course, that the foregoing relates to exemplary embodiments of the invention and that modifications may be made without departing from the spirit and scope of the invention as set forth in the following claims.

The invention claimed is:

1. A ballistic shield comprising:

a first body formed from a ballistic resistant material and sized to protect at least a torso of an individual;

a side panel on a side of the first body; and a movable corner panel that is movable in relation to the first body and is configured to move from an open position and a closed position so that in the closed position the corner panel can lock at least two shields together, wherein the first body is constructed to be connectable to at least one other body, the first panel and corner panel are configured to cover a gap between the first body and an adjacent second body.

2. The ballistic shield according to claim 1, further comprising a bottom panel on a bottom side of the first body that is configured to cover a gap between a bottom of the first body and an adjacent third body connected to the first body.

3. The ballistic shield according to claim 1, further comprising four connectors, an upper right connector in an upper right part of the first body, an upper left connector in an upper left part of the first body, a lower right connector in a lower right part of the first body, and a lower left connector in a lower left part of the first body, the connectors each constructed to have at least one slot configured to accept a part of a side panel, corner panel or bottom panel from an adjacent body.

4. The ballistic shield according to claim 3, wherein the upper right connector comprises a side slot for a second corner panel to slide in and an end slot to engage an end of the corner panel and prevent further sliding when the second corner panel is in a locked position, the upper left connector comprises a side slot for a third corner panel to slide in and an end slot to engage an end of the corner panel and prevent further sliding when the third corner panel is in a locked position, the lower left connector has a slot for a fourth corner panel to slide in, the lower right connector has a slot for the corner panel to slide in.

5. The ballistic shield according to claim 3, wherein the lower right connector retains the corner panel by engaging a groove in the corner panel so that the corner panel can slide in relation to the lower right connector but cannot be removed from the lower right connector.

6. The ballistic shield according to claim 4, further comprising at least four shields having their bodies adjacent to one another, with two above and two below to form a larger shield, the bottom panel of a top left body covers any gap between the top left body and the bottom left body, the bottom panel of a top right body covers any gap between the top right body and the bottom left body, the side panel of the top left body covers any gap between the top left body and the top right body, the side panel of the bottom left body covers any gap between the bottom left body and the bottom right body, the corner panel of the top left body is slid into a locking position to cover a gap between the four bodies.

7. The ballistic shield according to claim 6, wherein the four bodies are locked together by sliding the corner sliding panel of the first body into a locked position in which the locked corner panel contacts the slot of the left upper connecter of the bottom right body, the slot of the upper right connector of the bottom left body, the slot of the lower right connector of the upper left body, and the slot of the lower left connector of the upper right body.

8. A method of protecting a plurality of individuals comprising:

connecting a plurality of the ballistic shields according to claim 1 together to form a larger ballistic shield to protect a plurality of individuals.

9. The ballistic shield according to claim 1, wherein the first body has a size of 10 to 30 inches wide by 10 to 40 inches in length.

10. The ballistic shield according to claim 1, wherein the first body has a size of 15 to 25 inches wide by 15 to 30 inches in length.

11. A ballistic shield comprising:

a first body formed from a ballistic resistant material and sized to protect at least a torso of an individual, the first body having four corners and four sides;

a first connector in an upper right part of the first body having an associated first slot;

a second connector in an upper left part of the first body having an associated second slot;

a third connector in a lower right part of the first body having an associated third slot;

a fourth connector in a lower left part of the first body having an associated fourth slot;

a side panel on a side of the first body; and a first slidable corner panel that is slidable in relation to the first body and is configured to move from an open position and a closed position so that in the closed position the first slidable corner panel can lock at least two shields together by sliding into the first slot of the first body and a first, second, third or fourth slot of a second body, wherein the first body is constructed to be connectable to the second body with the first panel and the corner panel covering a gap between the first and second bodies.

12. The ballistic shield according to claim 11, further comprising at least four shields having their bodies adjacent to one another, with two above and two below to form a larger shield, a bottom panel of a top left body covers any gap between the top left body and the bottom left body, a bottom panel of a top right body covers any gap between the top right body and the bottom left body, the side panel of the top left body covers any gap between the top left body and the top right body, the side panel of the bottom left body covers any gap between the bottom left body and the bottom right body, the corner panel of the top left body is slid into a locking position to cover a gap between the four bodies, and the top left body is the first body.

13. The ballistic shield according to claim 12, wherein the four bodies are locked together by sliding the corner sliding panel of the first body into a locked position in which the locked corner panel contacts the slot of the left upper connecter of the bottom right body, the slot of the upper right connector of the bottom left body, the slot of the lower right connector of the upper left body, and the slot of the lower left connector of the upper right body.

14. The ballistic shield according to claim 11, wherein the first body has a size of 10 to 30 inches wide by 10 to 40 inches in length.

15. The ballistic shield according to claim 11, wherein the first body has a size of 15 to 25 inches wide by 15 to 30 inches in length.

16. A method of protecting a plurality of individuals comprising:

providing a plurality of ballistic shields each comprising:

a body formed from a ballistic resistant material and sized to protect at least a torso of an individual, the first body having four corners and four sides;

a first connector in an upper right part of the body having an associated first slot;

a second connector in an upper left part of the body having an associated second slot;

a third connector in a lower right part of the first body having an associated third slot;

a fourth connector in a lower left part of the first body having an associated fourth slot; and a side panel;

locking at least two shields together by sliding a slidable corner panel into the first slot of a first body and a first, second, third or fourth slot of a second body to form a larger ballistic shield to protect a plurality of individuals.

17. The method according to claim 16, further comprising connecting three shields together.

18. The method according to claim 16, further comprising connecting four shields together wherein the four shields having their bodies adjacent to one another, with two above and two below to form a larger shield, a bottom panel of a top left body covers any gap between the top left body and the bottom left body, a bottom panel of a top right body covers any gap between the top right body and the bottom left body, the side panel of the top left body covers any gap between the top left body and the top right body, the side panel of the bottom left body covers any gap between the bottom left body and the bottom right body, the corner panel of the top left body is slid into a locking position to cover a gap between the four bodies, and the top left body is the first body.

19. The method according to claim 16, wherein the first body has a size of 10 to 30 inches wide by 10 to 40 inches in length.

20. The method according to claim 16, wherein the first body has a size of 15 to 25 inches wide by 15 to 30 inches in length.

* * * * *